United States Patent [19]

Sado et al.

[11] Patent Number: 4,459,036

[45] Date of Patent: Jul. 10, 1984

[54] ELECTRONIC INSTRUMENT FOR SCHEDULED DATA HANDLING

[75] Inventors: Ichiro Sado; Juji Kishimoto, both of Tokyo; Masayuki Sasaki, Yokohama; Mitsuo Cho, Ina, all of Japan

[73] Assignee: Canon Kabushiki Kaisha, Tokyo, Japan

[21] Appl. No.: 313,580

[22] Filed: Oct. 21, 1981

Related U.S. Application Data

[63] Continuation of Ser. No. 087,707, Oct. 24, 1979, abandoned.

[30] Foreign Application Priority Data

Oct. 30, 1978 [JP] Japan ..... 53-149093
Nov. 21, 1978 [JP] Japan ..... 53-143900[U]

[51] Int. Cl.[3] ..... G04C 21/16; G04B 23/00

[52] U.S. Cl. ..... 368/251; 368/261; 364/709

[58] Field of Search ..... 368/72–74, 368/10, 107–113, 185, 187, 250, 251, 261; 364/705, 709, 710

[56] References Cited

U.S. PATENT DOCUMENTS

| | | | |
|---|---|---|---|
| 3,834,153 | 9/1974 | Yoda et al. | 368/251 |
| 3,999,050 | 12/1976 | Pitroda | 368/10 |
| 4,099,371 | 7/1978 | Mocazuki et al. | 368/251 |
| 4,104,863 | 8/1978 | Kondo | 368/261 |
| 4,107,916 | 8/1978 | Kondo | 368/251 |

*Primary Examiner*—Vit W. Miska
*Attorney, Agent, or Firm*—Fitzpatrick, Cella, Harper & Scinto

[57] ABSTRACT

The electronic instrument includes a memory for storing scheduled time and schedule details, a clock circuit producing time signals, a comparator producing a comparison signal in response to comparison and coincidence of the time signals from the clock circuit with the scheduled time, a discriminating memory with a storage of a signal for decision for and against clear of the scheduled time and details in the memory, and a control unit for discriminating, in response to the comparator producing the comparison signal, the storage of signal in the discriminating memory to control over clear and non-clear of the scheduled time and schedule details in the memory.

24 Claims, 9 Drawing Figures

| | | | | | | | | | | | | | | | | | | | | |
|---|---|---|---|---|---|---|---|---|---|---|---|---|---|---|---|---|---|---|---|---|
| WEEK INF=1 | | SUN. | MON. | TUE | WED. | THUR. | FRI | SAT | | | | | | | | | | | | |
| DATE INF=0 | | DATE | | | | | | | TIME INF | | | | | | | | | | | |
| | F1 | F2 | F3 | F4 | F5 | F6 | F7 | F8 | F9 | F10 | F11 | F12 | F13 | F14 | F15 | F16 | F17 | F18 | F19 | |
| R1 | 1 | 0 | 1 | 0 | 0 | 0 | 0 | 0 | 0 | 0 | 0 | 0 | 1 | 0 | 0 | 1 | 0 | 0 | 0 | ----MON. 2:08 |
| R2 | 0 | 0 | 1 | 1 | 0 | 0 | 0 | 0 | 0 | 0 | 1 | 0 | 1 | 0 | 0 | 1 | 1 | 1 | 1 | ----30. 5:15 |
| R3 | | | | | | | | | | | | | | | | | | | | |

ELECTRONIC INSTRUMENT FOR SCHEDULED DATA HANDLING

This is a continuation of application Ser. No. 87,707, filed Oct. 24, 1979, now abandoned.

BACKGROUND OF THE INVENTION

1. Field of the Invention

The invention relates to electronical instruments for scheduled data handling.

2. Description of the Prior Art

In conventional electronic desk calculators, when selected data are to be processed, they are committed to what is called an independent memory; anyway, however, among the data stored in the memory, there are those which, after their use, should require no further use, and those which should require still another use, and a careless operation of clear key for contents in the memory could clear the latter sort of storages without distinction.

With the progress of integrated circuit technology, there appeared those desk calculators as are provided with alarms memorizing and alarming for schedules. With the conventional calculators with alarms, when an operator had set a plurality of alarms for schedules, he could often fail, upon alarm, to identify the one among the plurality of alarms he had set. Despite appearance also of such desk calculators, where, to solve the problem, alphabetical or numerical symbols were introduced as comments for alarm and inputs, these means for help, however, not only increased duty of circuitry, but invited cumbersomeness in applying inputs.

SUMMARY OF THE INVENTION

In view of these points, the invention will offer improved electronic instruments.

The invention will offer electronic instruments such where a careless key operation would not directly erase the memory contents.

The invention will offer, for another object thereof, electronic instruments, where, to prevent the careless key operation from direct data clearing, a specified information paired with data is stored in the memory, so that, even upon operation of clear key, decision for and against erase of data in the memory is made dependent upon presence and absence of such specified information.

The invention will offer, for still another object thereof, electronic instruments with clock performance, where a scheduled time is stored and a warning given upon arrival of the time. Now the time is not simply to be erased by the previously associatedly used reset means and to meet the possible situation, a specified information is stored for decision for and against erase of the scheduled time.

The invention will offer, for yet still another object thereof, electronic instruments, where known symbol marks are selected for alarms, of general consent and readily comprehensible for any man.

BRIEF DESCRIPTION OF THE DRAWINGS

The invention will be better understood these and other objects thereof, when read the following descriptions of some forms of embodiment thereof in conjunction with the attached drawing, in which.

DESCRIPTION OF THE PREFERRED EMBODIMENTS

Figure 1:
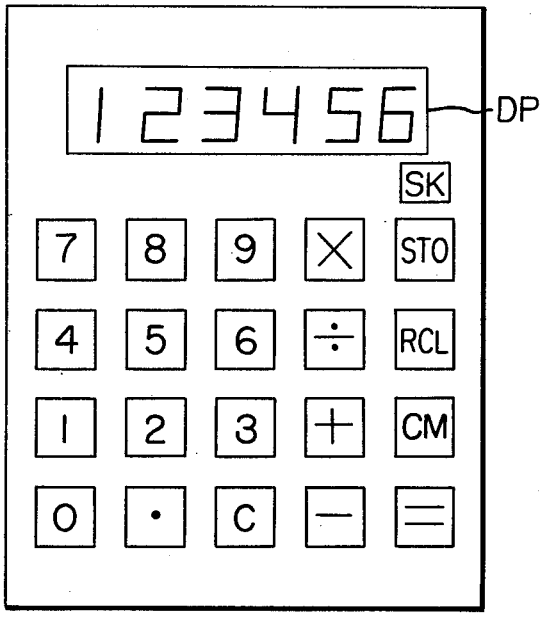
FIG. 1 is an outward view of an electronic instrument as a form of embodiment of the invention.

FIG. 1 is an outward view of an electronic instrument as a form of embodiment of the invention.

Referring to FIG. 1, keys "0, 1, . . . 9, and ." are for input of numerical informations, keys "×, ÷, +, −" for instructing arithmetic operation, a key STO for writing data in the previously mentioned independent memory, a key RCL for access to the data in the independent memory, a key CM for clearing contents of the independent memory, a key C for clearing memory contents except those in the independent memory, a key=for carrying out instructions of "×, ÷, +, −" of arithmetic operation, and a key SK for inputting information for preventing key CM from clearing contents of the independent memory.

Figure 2:
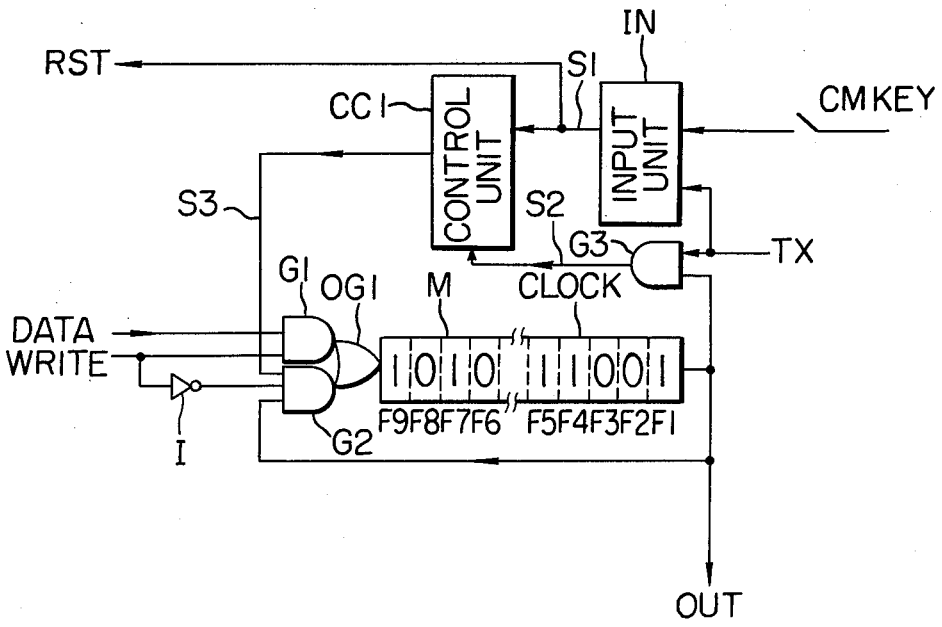
FIG. 2 is a schematic block diagram of the form of embodiment of FIG. 1.

FIG. 2 is a schematic block diagram of the main section of the electronic instrument of FIG. 1.

A memory M is, here, by way of example, a shift register with a plurality of successive binaries, and may be as an alternative for example a RAM (random-access memory) available of reading data from memory by giving address data or writing data in memory. Memory M will store data in the following way. At location F1 is stored specified information for decision for and against clear of the contents of the memory, and for this purpose is employed logical "1". At F2–F9 are stored data in sequence of F2–F9; it being "1" stored at F1, FIG. 2 indicates that stored data "0011, . . . , 0101" at F2–F9 are to be used; contents of information in memory M are sequentially shifted by clock pulses in the direction of F9, F8, . . . F1. It is noted that this memory M represents the previously mentioned independent memory in the desk calculator.

An input unit IN detects operation of memory clear key CM of the desk calculator and timing signal TX, and in every key CM operation interval, once outputs logical signal "1" onto signal line S1.

A control unit CC1 synchronizes with signal from input unit IN and, dependent on presence and absence of signal on signal line S2, outputs a signal, here normally "1", onto signal line S3.

An AND gate G1, responding to operation of data write key STO and through one of its terminals, stores and controls numerical signals "0–9" and data from other memories.

Also an AND gate G2 controls retention or non-retention of the contents of memory M. When signal is "1" on WRITE line for operation of key STO, signal "1" will be turned to "0" by inverter I to the closure of AND gate G2 preventing data in memory M from going back to F9 from F1. When signal is "0" on WRITE line, where signal "1" is applied to AND gate G2 for inverter I, data in memory M will make a circulation through AND gate G2. Of course, AND gate G2 having a terminal for receiving signal from control unit CC1, the described action stands on the assumption of control unit CC1 producing output signal "1".

An OR gate OG1 forwards outputs of AND gates G1 and G2 to memory M.

In an AND gate G3, discrimination is made between clear and non-clear of data in memory M. As previously referred to, for example, there is stored information at F1 in memory M for and against clear of data therein, and such information is stored at position F1 by key operation or by internal control circuit on the basis of kind of data. For example, if the information stands for retention of "1" and clear of "0", then, when such data at F1 is applied to AND gate G3, and a TX signal that should produce "1" applied to the other terminal of G3; consequently AND gate G3, responding to output of F1, will produce output hear of "1", and upon "1" on output signal line S2 of AND gate G3, control unit CC1 will turn signal on line S3 to "1" to the opening of AND gate G2 and circulation of data in memory M with the result of the contents of memory M uncleared; whereas the signal "0" on line S2, control unit CC1 will turn signal on line S3 to "0" to the closure of AND gate G2; consequently, data in memory M is not circulated but cleared.

Operation of the form above of the invention will be described below.

Referring to FIG. 1, numerical keys "0–9" are operated and corresponding coded signals arranged at F2–F9, with signal "1" at F1 as illustrated by key SK, and on line DATA by key STO. Such inputs may be completed by known key input control.

Figure 3:
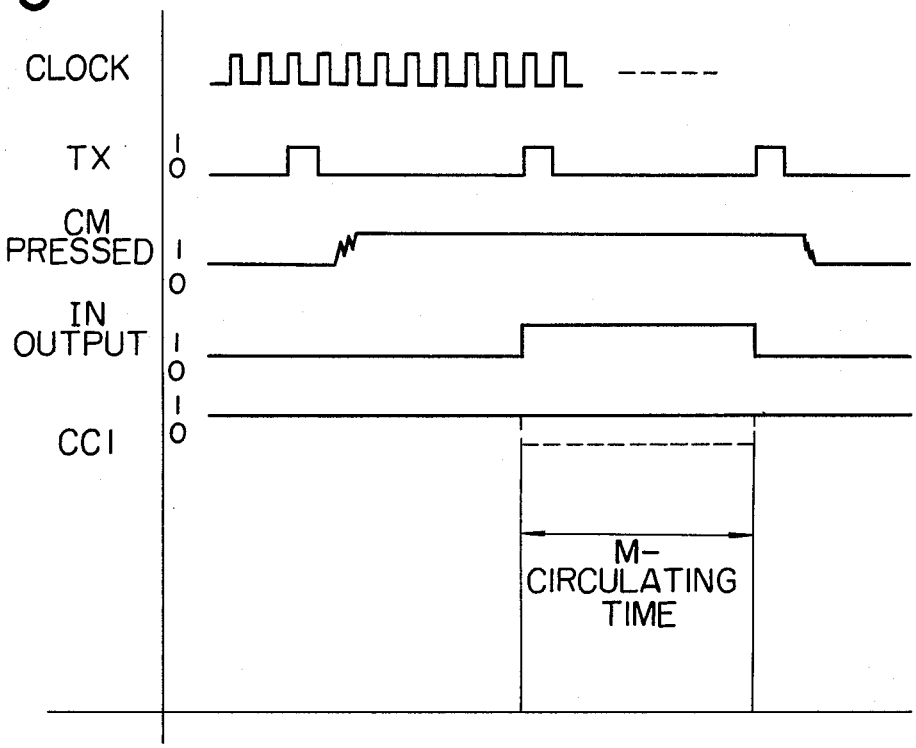
FIG. 3 shows waveforms of signals.

Contents of memory M are, upon no key operation, shifted per bit by clock pulses applied to the memory through AND gate G2, in circulation from F9, F8, . . . , F1, F9. On every timing for the specified information stored at F1 to be shifted to F9, signal "1" for the opening of AND gate G3 is applied to signal line TX as illustrated in FIG. 3 from a signal generating means (not shown) to decide the nature of the specified information. In this case, the specified information being "1", signal "1" is produced on line S2; but, control unit CC1, unable to come to the signal (FIG. 3 IN1 output) obtainable on operation of key CM from input unit IN, continues to produce signal "1", consequently AND gate G2 will not be closed and contents of memory M continues recirculation.

Upon careless operation of key CM, signal "1" is produced from input unit IN as illustrated the interval a full circulation is completed of the contents of memory M, responding to signal "1" on line TX. With the data being in memory M, when signal "1" appears on line TX, output of AND gate G3 will be "1" as mentioned, control unit CC1 receive signal "1" from input unit IN as well as signal "1" on line S2, and produce an output signal "1". If the specified information stored at F1 is "0", and key CM depressed, then signal "1" applied on line TX will result in signal "0" applied on line S2, the control unit CC1 detect signal "0" on S2 by signal "1" received from input unit IN, and continue to produce output signal "0" the interval of a full circulation of the contents of memory M, to the closure of AND gate G2 and the clear of the contents of memory M. The contents of memory M may, as previously mentioned, be re-written by re-write.

Figure 4:
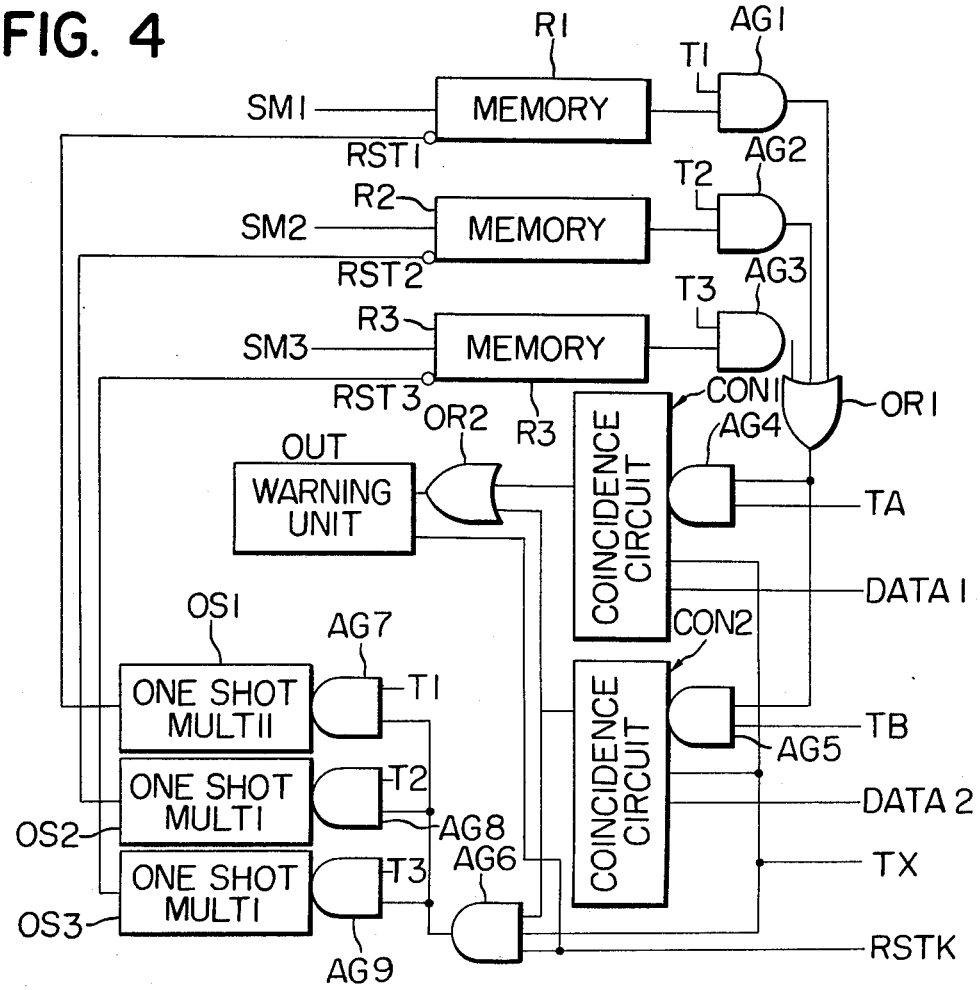
FIG. 4 is a schematic circuit diagram of another form of embodiment of the invention.

FIG. 4 is a schematic block diagram of another form of embodiment of the invention.

This form is of a design where the memory in the electronic instrument is made to store the scheduled time, give warning upon arrival of this time and reset the warning by a warning reset means, and furthermore, decide for and against erase of the scheduled time on basis of a specified information stored in company with the scheduled time. An exemplar will be described hereinbelow. Where there are inputs available for the day-and-time and the week-and-time information, the former is often for one time or occasion only, while the latter for intended regular proceedings or plan. Therefore, it will be recommendable for the day-and-time information to be cleared by the reset key while the week-and-time information not to be cleared. It is noted that the reference here to the day-and-time information should not include those on year and month.

Figures 5, 6:
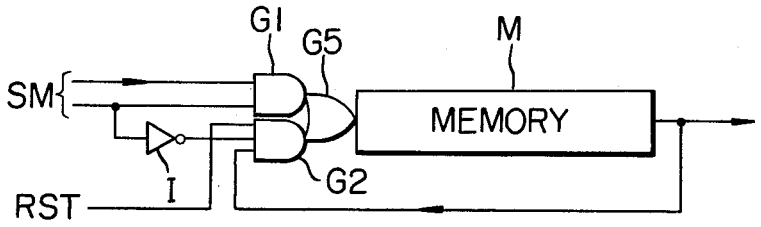
FIG. 5 is a detailed schematic diagram of the memory of FIG. 4.
FIG. 6 shows an arrangement of data in the memory of FIG. 4.

FIG. 4 shows a memory R1 of a design as illustrated in FIG. 5. Input and output controls over data are similar in nature to the form of embodiment of FIG. 2; the data write is carried out by signal on line SM; contents of memory M is prevented from circulation by signal on line RST and data cleared.

Data arranged in memory R1 are stored in a way such as illustrated in FIG. 6. At position F1 is stored signal "1" signifying the "the week" information, or "0" "the day" information: "1" at F1, it is the week information, specific days of the week indicated at F2–F8; thus "1" at F2 signifying "Sunday", at F3 "Monday", . . . at F8 "Saturday". Signal "0" at F1 signifies "the day" information, indeed days at F2–F8, viz. F2–F4 days of decimal number and F5–F8 those of digital number. Of locations F9–F19, are stored "time" information, indeed, at F9–F13 the "hour" information and at F14–F19 the "minute" information. In the illustrated memory R1 is stored "Monday, 8 minutes past 2 o'clock".

Memories R2 and R3 are similar in nature to R1.

Figure 7:
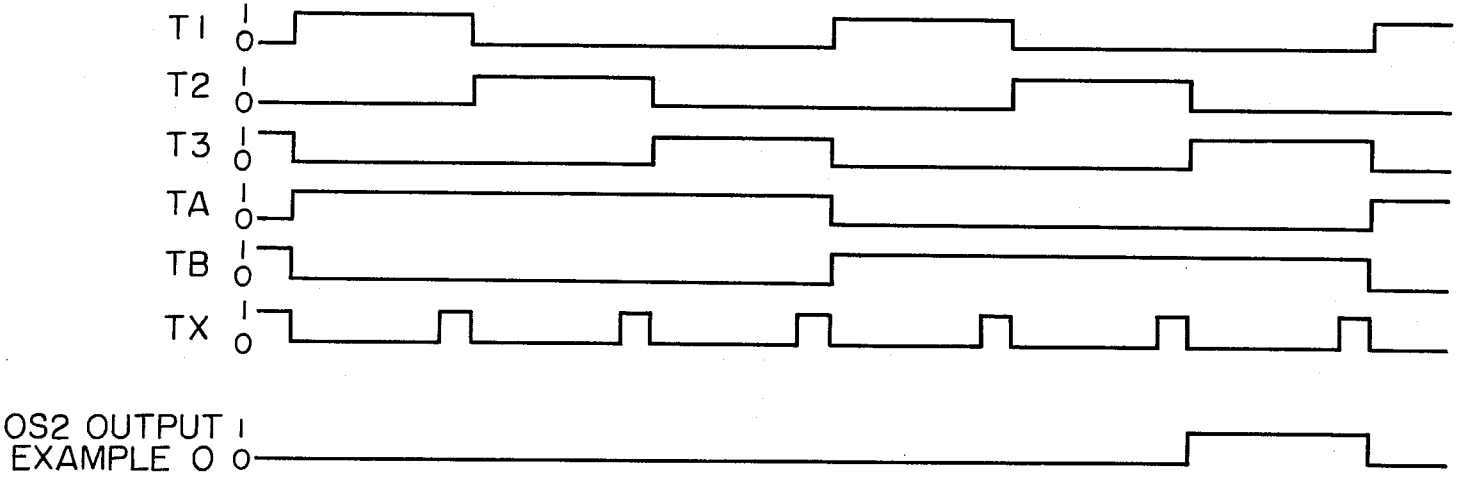
FIG. 7 depicts waveforms of signals.

AND gates AG1–AG3 transfer respectively contents of memories or R1–R3, and to them are applied such timing signals T1–T3 respectively as illustrated in FIG. 7. Timing signals T1–T3 are such as stand "1", the interval the memories R1–R3 complete respectively a full circulation (one-word interval), and obtained from an unillustrated signal generating means.

An OR gate Or1 operates to transfer outputs of AG-1–AG3 to the next stage.

An AND gate AG4 passes output of OR gate OR1 by timing signal TA illustrated in FIG. 7.

A coincidence circuit CON 1 is eqergized through AND gate AG4 in reference to the current "week-and-time" information DATA1 which is transmitted from an unillustrated clock means. It performs comparison with the contents of memories R1–R3 and detection, among others through AND gate, of "the day" information distinguishable by timing signal TX illustrated in FIG. 7.

An AND gate AG5 passes data output from OR gate OR1 by timing signal TB in FIG. 7.

A coincidence circuit CON2 refers to the "day-and-time" information output from an unillustrated clock means, compares with R1–R3 data transmitted through AND gate AG5, and recognizes the week information among others through AND gate, by timing signal TX.

An OR gate OR2 passes coincidence outputs from coincidence circuits CON1 and CON2 and drives a sounding circuit OUT, for example, for buzzer.

An AND gate AG6 receives inputs from coincidence circuit CON2, timing signal TX and means for clearing the warning means (key or control circuit) and delivers output "1", upon all of these inputs being simultaneously "1".

AND gates AG7–AG9 will deliver output "1" of AND gate AG6 by timing signals T1–T3 to and drive one-shot multivibrators OS1–OS3, these multivibrators being connected respectively to signal lines RST1–RST3 respectively of memories R1, R2 and R3, for the contents of the memories to be cleared. Outputs of one-shot multivibrators OS1–OS3 are signals to be "1" for the one-word interval. Operation of this form of design will be hereinbelow described. Assumed that memory R1 carries a storage of "week-and-time" information "monday, 8 minutes past 2 o'clock", and memory R2 a storage of "day-and-time" information "30th, 15 minutes past 5 o'clock", and that coincidence circuit CON2, upon coincidence of the contents of memory R2 and the current day-and-time information DATA2, delivers an output by timing signals T2 and TX, furthermore, the reset signal RSTK applied, upon moment of timing signals T2 and TX, through AND gate AG6, to a terminal of each of AND gates AG7 AG9, for AND gate AG8 to deliver an output "1", as result of the "AND" of the timing signals T1 T3, one-shot multivibrator OS2 will continue to deliver an output signal "1", the one-word interval, onto signal line RST2. Consequently, the contents of memory R2 would not make recirculation by the signal "1" of one-shot multivibrator OS2, but all turn to "0". Reset signal RSTK resets the buzzer circuit OUT in warning.

When the contents of memory R2 are led by timing T2 to coincidence circuit CON2, this does not deliver coincidence output, because of the contents of R2 being all turned to "0". On the other hand, when "monday, 8 minutes past 2 o'clock" stored in memory R1 proves to coincide with the current week-and-time information DATA1 through coincidence circuit CON1, buzzer circuit OUT is driven through OR gate OR2 on T1–TX timing.

In accordance with the inventive electronic instrument, as far described, it is designed that the week-and-time information should be recognized at coincidence circuit CON1 and the day-and-time information at CON2, and that the memory should be cleared by "logic" of the output of one of the coincidence circuits and the reset signal, so that there may occur no careless erase of necessary data.

In accordance with the invention, the data storage is provided with a specified sign or code, which despite occurrence of a clear signal originating from clear key or internal control, will not permit clear of the datastorage, rendering reset unnecessary of such storage. Still another form of embodiment of the invention will be described hereinbelow referring to the drawing.

Figure 8:
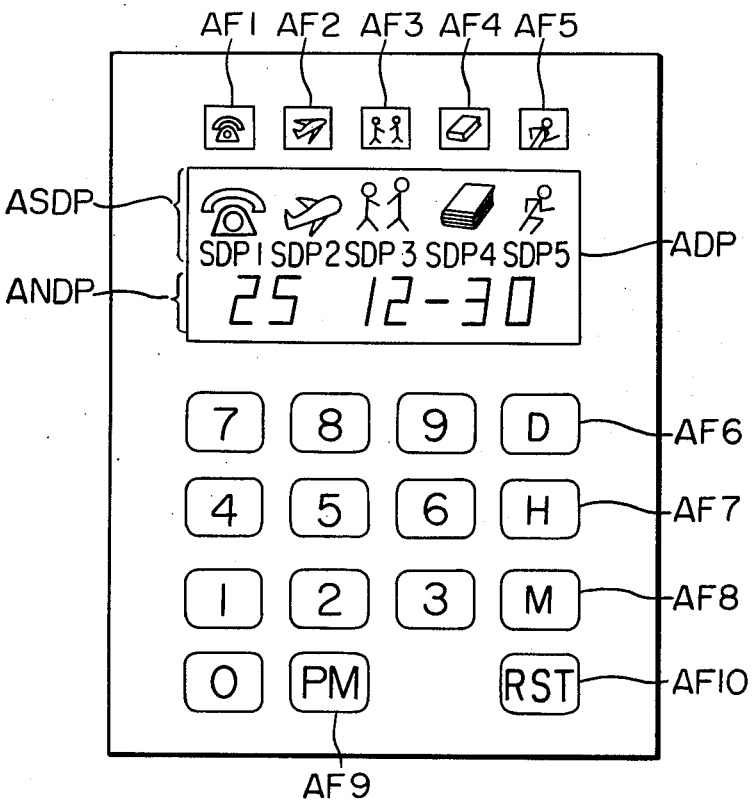
FIG. 8 is an outward view of still another form of embodiment of the invention.

FIG. 8 is an outward view of the form mentioned above. Referring to FIG. 8, AF1–AF5 designate symbol mark keys for inputting symbol marks.

Display section ADP carries symbol mark indicators ASDP and numerical figure indicators ANDP. Referring to ASDP, ASDP1 carries symbol mark for telephony, ASDP2 for flight, ASDP3 rendezvous, ASDP4 book-reading and ASDP5 going out.

Keys AF6–AF8 are respectively of instructive of day, hour and minute to the instrument, a key AF9 instructive of PM, a key AF10 for reset of information inputted to the instrument and keys 0–9 instructive of numerical numbers.

Figure 9:
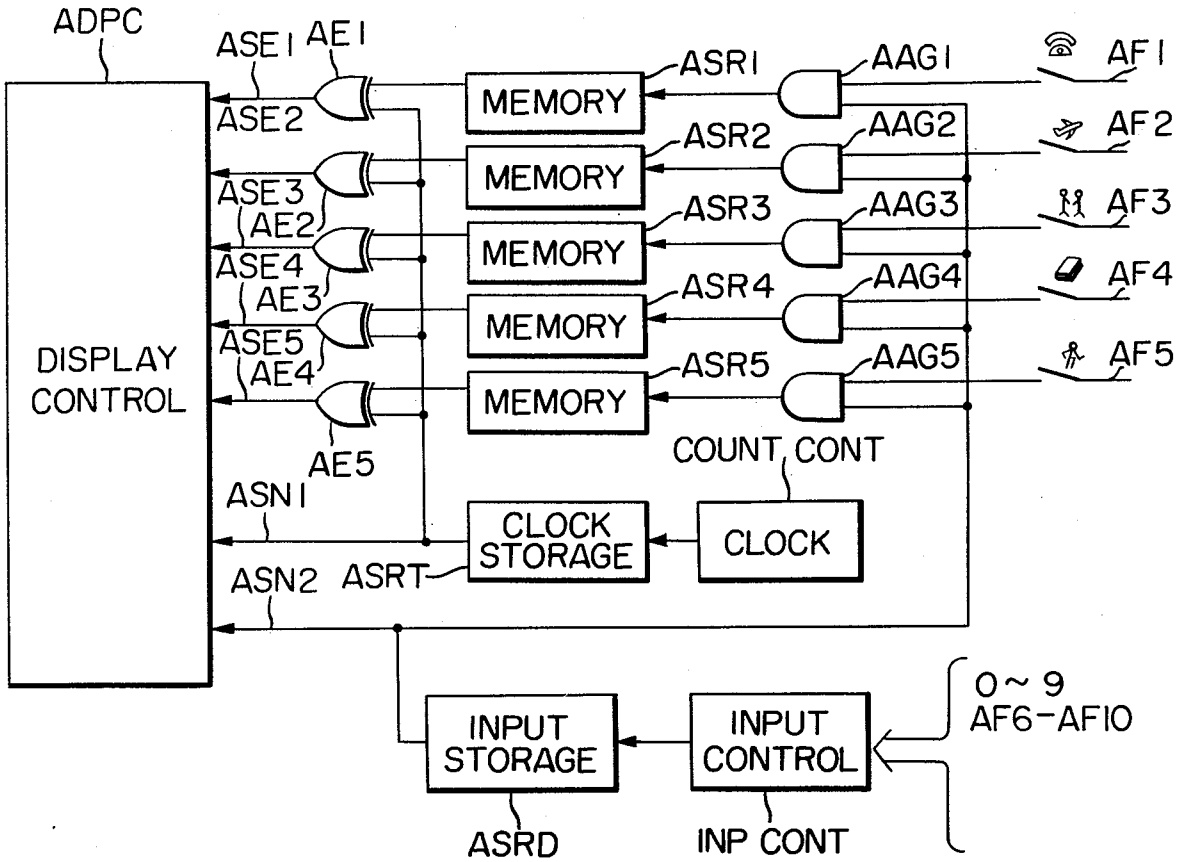
FIG. 9 is a schematic block diagram of the form of embodiment of FIG. 8.

FIG. 9 is a block diagram showing the illustrative embodiment of FIG. 8. Referring to FIG. 9, INP CONT an input control unit INP CONT comprises among others an encoder for converting into binary code information being inputted by operation of keys 0–9 and AF6–AF10. An input information memory unit ASRD stores numerical information indicative of days and hours and their recognisatory informations, inputted by keys 0–9. AAG1–AAG5 input to memories ASR1–ASR5 those information stored in input information memory unit ASRD by operating symbol mark input keys AF1–AF5.

Memories ASR1–ASR5 are provided corresponding to symbol mark indicators SDP1–SDP5. Each symbol has one memory, which may be pluralized, where then to be provided with a stack pointer for specification.

A clock unit COUNT CONT comprises among others a crystal oscillator and counter.

Clock information memory unit ASRT stores clock information from clock unit COUNT CONT.

Comparison circuits AE1–AE5 compare contents of memories ASR1–ASR5 with those of clock information memory unit ASRT and deliver output upon agrement.

Circuit ADPC controls display section ADP and a display control unit, will bring to display symbol marks ASDP1–ASDP5 by output signals ASE1–ASE5 from comparison circuits AE1–AE5, as well as output signal ASN1 of clock information memory unit ASRT and that of ASN2 of input information memory unit ASRD by means of indicators ANDP. Operation of the foregoing form of the invention will be described hereinbelow.

By way of example, in setting a memorandum "Telephone on 25th, 30 minutes past 12 o'clock" in the instrument, keys for numerals and day-and-time are operated to store in input information memory unit ASRD the key informations of "25th, 30 minutes past 12 o'clock", then, upon operation of key AF1, the contents of input information memory unit ASRD are stored at memory ASR1 through gate AAG1.

It is noted in this example that keys F6–F8 have their displays for day, hour and minute respectively followed by signs of space, hyphen and space, which may be replaced with any other signs. The memorandum is inputted to the instrument as described. Upon operation of other keys F2–F5 indicative of other symbol marks, corresponding contents in input memory information unit ASRD may be stored at memories ASR2–ASR5 through gates operable by corresponding keys.

When contents of clock information memory unit ASRT for storage of the contents of clock unit COUNT CONT are "25th, 30 minutes past 12 o'clock", and comparison circuit AE1 proves agreement of memory ASR1 and memory unit ASRT in content, output signal ASE1 is delivered to signal display control unit ADPC to the display of symbol mark ASDP1. Consequently, the operator may come to the knowledge of the necessity of telephony.

It may be designed for buzzer to be given by outputs of comparison circuits AE1–AE5.

In this form of embodiment of the invention, commenting symbol keys AF1–AF5 are designed to store input day-and-time information at specified memories. It may also be to the purpose to design that these memories are made to store in company with the informations indicative of symbol marks, and upon agreement in comparison of the day-and-time informations with the contents of the clock unit, informations indicative of symbol marks are transmitted to the display control unit for them to be decoded by decoder or so and for symbol mark indicators ASDP1–ASDP5 to be driven to display.

What is claimed is:

1. Electronic apparatus comprising:

means for generating an access signal;

memory means having first storage locations each for storing data information therein, and second storage locations, each associated with one of said first storage locations and each for storing specified information therein representative of whether the data information stored in the associated one of said first storage locations is to be cleared therefrom, said memory means further reading or writing data information into or out of said first sorage locations in response to an access signal generated by said generating means; and control means, responsive to an instruction for causing the data information stored in one of said first storage locations to be cleared, for controlling whether or not said one of said first storage locations in said memory means is cleared in accordance with the presence or absence of the specified information stored in said second storage location with which said one first storage location is associated.

2. Apparatus in accordance with claim 1, further comprising a key operable for causing the specified information to be stored in any one of said second storage locations of said memory means.

3. Apparatus in accordance with claim 1, further comprising discriminating means for discriminating the kind of data information stored in said first storage locations of said memory means, and means for causing the specified information to be stored in said second storage locations in accordance with the discrimination of said discriminating means.

4. Apparatus in accordance with claims 1, 2 or 3, further comprising means for writing new data information and specified information respectively into one of said first storage locations and the associated one of said second storage locations which have stored both previous data information and previous specified information, so as to clear said previous data information and previous specified information.

5. Electronic apparatus comprising:

means for generating an access signal;

memory means having storage locations each storing therein a scheduled time and specified information associated with the scheduled time, said memory means further reading or writing at least one of scheduled times and specified information into and out said storage locations in response to said access signal generated by said generating means;

clock means for generating time information;

comparator means for comparing the scheduled times stored in the storage locations with the time information, and producing a coincidence signal when the scheduled time is coincident with the time information; and control means responsive to the coincidence signal for controlling whether or not the scheduled time, which is coincident with the time information, is cleared in accordance with the presence or absence of the specified information in the storage location including the scheduled time.

6. Apparatus in accordance with claim 5, further comprising a key operable for causing the specified information to be stored in the respective storage locations of said memory means.

7. Apparatus in accordance with claim 5, further comprising discriminating means for discriminating the kind of data information stored in the respective storage locations of said memory means, and means for causing the specified information to be stored in the respective storage locations in accordance with the discrimination of said discriminating means.

8. Apparatus in accordance with claim 5, 6 or 7, further comprising means for writing new data information and specified information into one of said storage locations which has stored both previous data information and previous specified information, so as to clear said previous data information and previous clearing information.

9. Electronic apparatus comprising:

memory means having storage locations each storing therein a scheduled time and clearing information associated with the scheduled time, clock means for generating time information;

comparator means for comparing the scheduled times stored in the storage locations with the time information, and producing a coincidence signal when the scheduled time is coincident with the time information;

control means responsive to the coincidence signal for controlling whether or not the scheduled time which is coincident with the time information is cleared in accordance with the presence or absence of the clearing information in the storage location including the scheduled time;

discriminating means for discriminating the kind of data information stored in the respective storage locations of said memory means, and means for causing the clearing information to be stored in the respective storage locations in accordance with the discrimination of said discriminating means.

10. Apparatus in accordance with claim 9 further comprising means for writing new data information and clearing information into one of said storage locations which has stored both previous data information and previous clearing information, so as to clear said previous data information and previous clearing information.

11. Electronic apparatus comprising:

memory means having storage locations for storing therein data information and clearing information associated with the data information;

control means, responsive to an instruction for causing the data information stored in one of said storage locations to be cleared, for controlling whether or not said one of said storage locations in said memory means is cleared in accordance with the presence or absence of the clearing information in said one of said storage locations, and discriminating means for discriminating the kind of data information stored in said storage locations of said memory means, and means for causing the clearing information to be stored in said storage locations in accordance with the discrimination of said discriminating means.

12. Apparatus in accordance with claim 11 further comprising means for writing new data information and new clearing information into one of said storage locations which has stored both previous data information and previous clearing information, so as to clear said previous data information and previous clearing information.

13. Electronic apparatus comprising:

means for generating an access signal;

memory means having a first storage location for storing data information and a second storage location for storing specified information representative of whether the data information stored in said first storage location is to be cleared therefrom, said memory means further reading or writing data information into and out of said first storage location in response to an access signal generated by said generating means; and control means, responsive to an instruction for causing the data information stored in said first storage location to be cleared, for controlling whether or not said first storage location in said memory means is cleared in accordance with the presence or absence of the specified information stored in said second storage location.

14. Electronic apparatus in accordance with claim 13, further comprising input means for entering said instruction into said electronic apparatus.

15. Electronic apparatus in accordance with claim 13, further comprising means for writing new data information into said first storage location and for writing new specified information into said second storage location.

16. Electronic apparatus comprising:

means for generating an access signal;

memory means having a storage location storing a scheduled time and specified information associated with the scheduled time, said memory means further reading or writing at least one of scheduled times and specified information into and out of said storage location in response to said access signal generated by said generating means;

clock means for generating time information;

comparator means for comparing the scheduled time stored in said storage location with the time information, and producing a coincidence signal when the scheduled time coincident with the time information; and control means responsive to the coincidence signal for controlling whether or not the scheduled time, which is coincident with the time information, is cleared in accordance with the specified information in said storage location including the scheduled time.

17. Electronic apparatus in accordance with claim 16, further comprising input means for entering instructions into said electronic apparatus.

18. Electronic apparatus in accordance with claim 16, further comprising means for writing new data information and said specified information into said storage location.

19. Electronic apparatus comprising:

means for generating an access signal;

memory means for storing data information, said memory means further reading or writing said data information into and out thereof in response to said access signal produced by said generating means;

means for discriminating whether or not said data information is to be cleared in accordance with a portion of said data information; and means for clearing said data information stored in said memory means in response to discrimination of said discriminating means.

20. Electronic apparatus in accordance with claim 19, wherein said memory means includes plural memory locations each storing said data information.

21. Electronic apparatus in accordance with claim 20, wherein said discriminating means includes comparator means.

22. Electronic apparatus comprising:

memory means having first storage locations each for storing data information therein, and second storage locations, each associated with one of said first storage locations and each for storing specified information therein representative of whether the data information stored in the associated one of said first storage locations is to be cleared therefrom;

control means, responsive to an instructions for causing the data information stored in one of said first storage locations to be cleared, for controlling whether or not said one of said first storage locations in said memory means is cleared in accordance with the presence or absence of the specified information stored in said second storage location with which said one first storage location is associated; and discriminating means for discriminating the kind of data information stored in said first storage locations of said memory means, and means for causing the specified information to be stored in said second storage locations in accordance with the discrimination of said discriminating means.

23. Apparatus in accordance with claim 22, further comprising a key operable for causing the specified information to be stored in any one of said second storage locations of said memory means.

24. Apparatus in accordance with claims 22 or 23, further comprising means for writing new data information and specified information respectively into one of said first storage locations and the associated one of said second storage locations which have stored both previous data information and previous specified information, so as to clear said previous data information and previous specified information.

* * * * *

UNITED STATES PATENT AND TRADEMARK OFFICE

CERTIFICATE OF CORRECTION

PATENT NO. : 4,459,036

DATED : July 10, 1984

INVENTOR(S) : ICHIRO SADO, ET AL.

It is certified that error appears in the above-identified patent and that said Letters Patent is hereby corrected as shown below:

Column 1

Line 10, change "electronical" to --electronic--.

Column 3

Line 57, change "receive" to --receives--,

Line 58, change "produce" to --produces--,

Line 62, change "detect" to --detects--

Line 63, change "continue" to --continues--.

Column 4

Line 23, change "is" to --are--,

Line 51, change "eqergized" to --energized--.

Column 5

Line 7, delete "and" before "drive".

Line 24, change "AG7 AG9" to --AG7 - AG9--.

UNITED STATES PATENT AND TRADEMARK OFFICE

CERTIFICATE OF CORRECTION

PATENT NO. : 4,459,036

DATED : July 10, 1984

INVENTOR(S) : ICHIRO SADO, ET AL.

It is certified that error appears in the above-identified patent and that said Letters Patent is hereby corrected as shown below:

Column 5 (continued)

Line 26, change "T1 T3" to --T1 - T3--,

Line 44, insert --so-- following "as".

Column 7, line 17
Claim 1, line 11

Change "sorage" to --storage--.

Column 7, line 55
Claim 5, line 8

Insert --of-- following "out".

Column 9, line 44
Claim 16, line 14

Insert --is-- before "coincident".

UNITED STATES PATENT AND TRADEMARK OFFICE

CERTIFICATE OF CORRECTION

PATENT NO. : 4,459,036

DATED : July 10, 1984

INVENTOR(S) : ICHIRO SADO, ET AL.

It is certified that error appears in the above-identified patent and that said Letters Patent is hereby corrected as shown below:

Column 10, line 30
Claim 22, line 10

Change "instructions" to -- instruction --.

Signed and Sealed this

*Ninth* Day of *April 1985*

[SEAL]

*Attest:*

DONALD J. QUIGG

*Attesting Officer* *Acting Commissioner of Patents and Trademarks*